US005615695A

United States Patent [19]

Chambers

[11] Patent Number: 5,615,695

[45] Date of Patent: Apr. 1, 1997

[54] PULSATER FLUID SYSTEM FLUSHER

[76] Inventor: Harvey E. Chambers, 3395 Fox St., Suite 102C, Duluth, Ga. 30136

[21] Appl. No.: 573,544

[22] Filed: Dec. 15, 1995

[51] Int. Cl.[6] ..... B08B 3/04; B08B 9/02

[52] U.S. Cl. ..... 134/102.1; 134/104.2; 134/169 C; 239/317

[58] Field of Search ..... 134/102.1, 102.2, 134/104.2, 169 R, 169 A, 169 C; 239/311, 317, 318, 373

[56] References Cited

U.S. PATENT DOCUMENTS

| | | | |
|---|---|---|---|
| 3,165,114 | 1/1965 | Garrett | 239/317 X |
| 3,188,238 | 6/1965 | Lyon | 134/102.2 X |
| 3,232,482 | 2/1966 | Stock et al. | 134/102.2 X |
| 5,097,806 | 3/1992 | Vataru et al. | 134/169 A X |
| 5,425,333 | 6/1995 | Baylor et al. | 134/169 A X |
| 5,485,857 | 1/1996 | Amundsen | 134/102.2 |

*Primary Examiner*—Philip R. Coe
*Attorney, Agent, or Firm*—William F. Hamrock

[57] ABSTRACT

The disclosure relates to an apparatus and method for cleaning fluid lines by use of an improved inline manifold. The manifold controls the flow of cleaning liquid causing a pulsing action of an atomized mixture of cleaning liquid and air through the fluid lines. The apparatus includes a hose for carrying cleaning fluid and air to the fluid lines, a source of compressed air, an enclosed tank containing cleaning liquid and the manifold operatively connected to the air source and the tank.

22 Claims, 4 Drawing Sheets

PULSATER FLUID SYSTEM FLUSHER

BACKGROUND OF THE INVENTION

1. Field of the Invention

The invention relates to an apparatus and method for cleaning fluid lines and, in particular, to an improved in-line manifold which controls the flow of cleaning liquid causing a pulsing action of an atomized mixture of cleaning liquid and air through the fluid lines.

2. Description of Prior Art

Fluid lines are widely employed for carrying fluid through automobile air conditioning systems, automatic transmission systems, transmission air cooler heat exchanger systems and various hydraulic systems in general. A major problem with these fluid lines is that they become partially or completely clogged and contaminated. The problem is often so serious as to require removal of the entire system in order to flush out the fluid lines with a cleaning liquid such as a solvent. Usually, such cleaning is performed by introducing a cleaning solvent such as mineral spirits or other compounded cleaning solvent into the lines.

Many of the various methods of cleaning and unclogging such fluid lines have proven to be time consuming, ineffective or incomplete, and expensive. Also, there is a problem with the safe collection of the used solvent and of filtering and reuse of it which is an additional expense to service shops.

SUMMARY OF THE INVENTION

It is an object of this invention to provide a new and improved apparatus and method for cleaning fluid lines.

It is another object of this invention to provide an improved apparatus for cleaning fluid lines that is relatively simple and safe to use.

It is further object of this invention to provide novel air and liquid manifold mounted on a cleaning liquid tank which supplies cleaning liquid and air to flush the fluid lines.

It is another further object of this invention to provide a drain system to collect the contaminated cleaning liquid for reuse or disposal and filter the vapors emitted from the solvent.

It is another further object of this invention to provide a method of cleaning the fluid lines by means or a rapid pulsing atomized cleaning liquid and air.

Other objects and advantages or this invention wilL be apparent from the following.

According to one aspect of the present invention, an apparatus for cleaning fluid lines is provided which includes a source of compressed air controlled by an air valve which is operatively connected to a unique air and liquid manifold operatively mounted on an enclosed cleaning liquid tank. A flush hose carries atomized cleaning solution and air from the outlet of the manifold tank system into and through the fluid lines being cleaned. A drain hose carries contaminated cleaning liquid from the outlet of the fluid lines into a drain tank having a hose barb, an atomized solvent defuser and air filter therein to separate the cleaning liquid for reuse or disposal.

The unique air and liquid manifold of the present invention includes the air valve which controls the flow of air into a main air chamber through which compressed air simultaneously enters openly communicated upstream branch air passage member transversely extending therefrom and an openly communicated downstream air passage member forwardly extending therefrom. The upstream air passage member has a predetermined calibrated sized air bleed orifice which communicates with the cleaning liquid tank and critically restricts the flow of air into the tank by means of its calibrated size. This critical restriction of air through the calibrated air bleed orifice causes only a small increase in the air pressure in the tank which gradually increases to force the cleaning liquid up a vertical drop tube in the tank into an openly communicated cleaning liquid receiving cavity and into an openly communicated downstream liquid passage transversely extending longitudinally therefrom in the manifold. A shut-off valve is operatively positioned along the length of the downstream liquid passage to control the downstream flow of cleaning liquid in the manifold. At its outlet end, the downstream liquid passage member is integrally connected and openly communicated with downstream cleaning liquid interior tube having a bore which carries cleaning liquid and which, for most of its length, extends longitudinally through the downstream air passage, longitudinally through a rear air channel of a threadedly connected venturi hose barb and terminating within a restricted diameter sized air and liquid front channel of the venturi hose barb. Said hose barb is secured to said downstream air passage member so that part of said rear air channel and the entire air and liquid front channel of said hose barb project beyond the exterior edge of said manifold. A flush hose is attached to the exterior surface of said venturi portion which carries the cleaning liquid and air to the fluid lines being cleaned from said hose barb.

When compressed air flows into the larger diameter downstream air passage, it flows around the exterior of the liquid interior tube through the larger diameter rear air channel and into said restricted diameter front channel of said venturi hose barb with increased velocity. As the air flows with increased velocity through said restricted front channel, venturi action occurs at the terminal end of said interior tube increasing the cleaning liquid flow from said cleaning liquid tank through the liquid flow system, through the cleaning liquid interior tube. The cleaning liquid flowing from the interior tube becomes an atomized mixture with the compressed air. Concurrently with the increased flow of cleaning liquid through the liquid system, the air passing through said air bleed orifice causes a small gradual increase in the air pressure in said cleaning liquid tank forcing cleaning liquid up the said drop tube through the liquid carrier system and interior tube. As the cleaning fluid is forced from said cleaning liquid tank with increased velocity, a small reduction in air pressure occurs in said tank hesitantly interrupting the flow of cleaning liquid up said drop tube until air pressure immediately builds up again in said tank. The continuous rising and falling pressure in said tank resulting from the cleaning liquid intermittently leaving said tank causes a rapid pulsing action for the cleaning liquid through the system and as it enters said hose and enters the fluid lines to be cleaned. This pulsing action increases the ability of the apparatus to dislodge and remove from the fluid lines being cleaned particles and debris which would not be removed by a constant flow of cleaning liquid.

Another embodiment of the present invention is a drain system to collect the used cleaning liquid for reuse or disposal. In this embodiment, used atomized cleaning liquid and air exiting the flushed fluid lines are directed through a drain hose to a drain container through a drain hose barb and elbow to a liquid diffuser where the spent cleaning liquid is collected.

DETAILED DESCRIPTION OF THE DRAWINGS

DESCRIPTION OF THE PREFERRED EMBODIMENT

Figure 1:
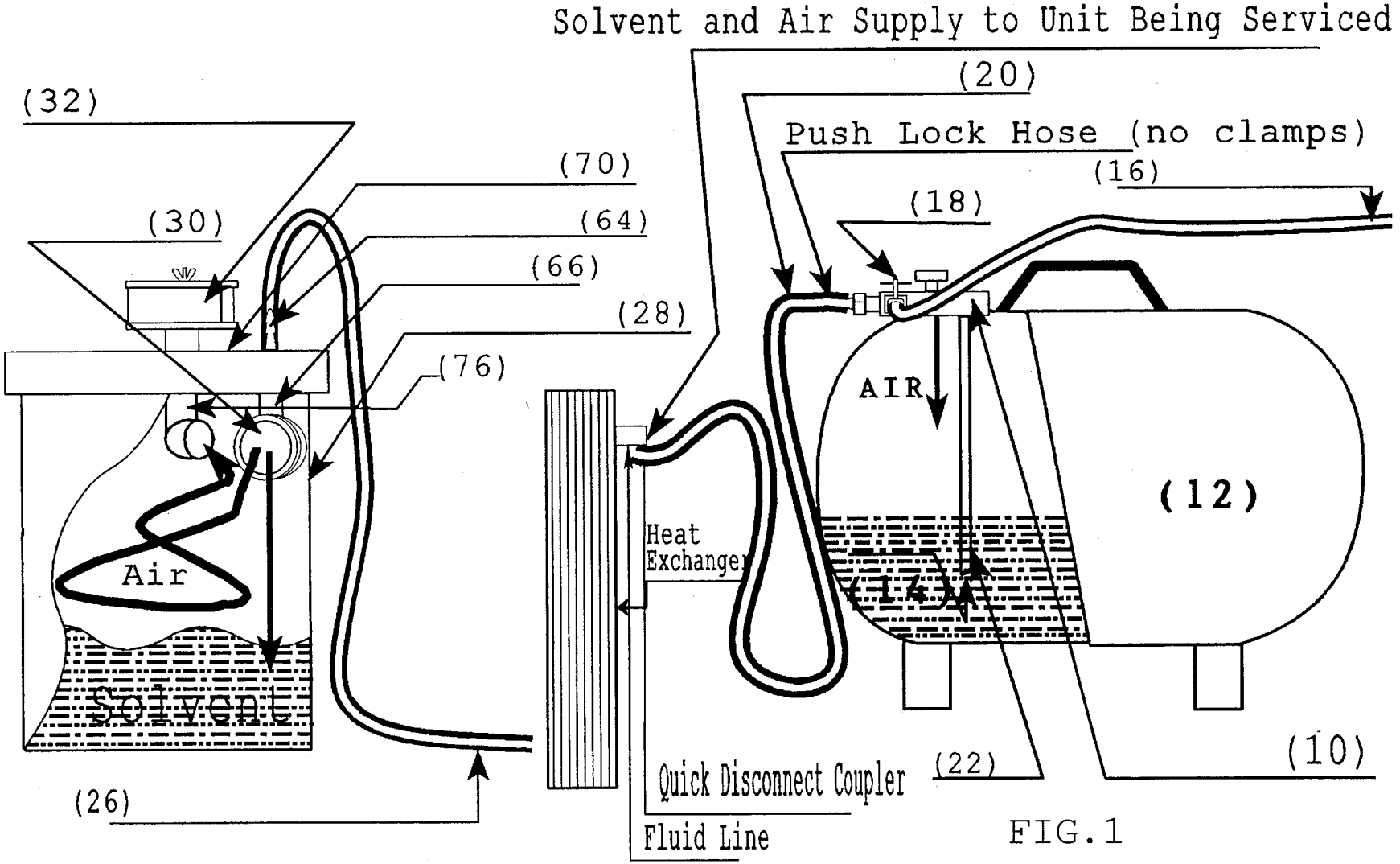
FIG. 1 is a view of one embodiment of the invention showing partly in section the entire arrangement of the apparatus for cleaning fluid lines and collecting contaminated cleaning fluid.

Referring to FIG. 1, there is illustrated generally a preferred embodiment of the invention showing the overall arrangement of the apparatus for cleaning contaminated fluid lines and for collecting and filtering the contaminated cleaning liquid or solvent for reuse or disposal. The apparatus of this embodiment comprises air and liquid manifold 10 communicably connected to the top of enclosed cleaning liquid or solvent tank 12 for supplying compressed air to the tank and removing cleaning liquid therefrom. The compressed air is supplied to the tank above the cleaning liquid, such as solvent 14 for example mineral spirits, in the bottom of the tank. Compressed air hose 16 delivers compressed air from a compressed air source, not shown, through a threadedly connected quick disconnect nipple or similar device to threadedly connected air valve 18 whereby said air flows through the air flow system in the manifold to the flush hose 20. Drop tube 22 is connected at its upward end in open communication to the manifold attached to the top of the tank. The opposite end of drop rude descends into the solvent in the tank wherein the solvent is forced up said tube into the solvent flow system manifold and into connected flush hose 20. A description of the air and solvent flow in the manifold causing a pulsing action of an atomized mixture of solvent and air will be discussed relative to FIGS. 2, 3 and 4.

As seen in FIG. 1, flush hose 20 carries the atomized mixture of solvent and air to the inlet of the fluid lines to be cleaned such as in a heat exchanger 24. The pulsing action of the atomized solvent and air mixture passes through the fluid lines and removes the contamination therefrom. One end of return hose 26 is attached to the outlet of heat exchanger 24 and carries the flushed contaminated atomized solvent and air mixture from the cleaned fluid lines to drain container 28. The opposite end of return hose 26 is connected to an atomized solvent defuser 30 where the solvent is separated and collected at the bottom of the drain container. An activated charcoal filter 32 shown attached to the top exterior of the container and communicably disposed within the interior removes impurities from the air passing out of the container. In operation of the unique air and solvent manifold embodiment of the invention, depicted in FIGS. 2, 3 and 4, the outlet end of compressed air hose 16 is releasably attached to the inlet of manual shut off air valve 18 which threadedly connects into main air chamber passage 34 through the manifold threaded side inlet. The main air chamber passage extends partially across the width of the manifold to terminally and openly connect with opening 37 downstream of air passage 36 and to intersect openly with upstream branch air passage 38 and safety relief branch air passage 40 transversely extending from each side crosswise midway along its length. The upstream branch air passage

38 has a predetermined calibrated sized air bleed orifice 42 which communicates with solvent tank 12 when attached to the tank as in FIG. 1. The size of orifice 42 is calibrated to restrict the flow of compressed air into the air space above the solvent in the tank. By limiting the flow of air through the orifice into the tank, there is permitted only a gradual small increase in the air pressure occurring in the air space in the tank which small increase is sufficient to force the solvent up drop tube 22 into the manifold. The predetermined calibrated size of orifice 42 in combination with other features of the apparatus to be discussed is a major contributing link of the unique and efficient cleaning operation of the apparatus.

The upward end of drop tube 22 is openly connected to solvent receiving cavity 44 in the interior of the manifold which is openly communicated with downstream solvent passage 46 transversely extending longitudinally therefrom. Downstream liquid passage 46 has a manual one quarter turn shut-off valve 48 positioned midway along its length which opens and closes the passage to selectively regulate the downstream flow of solvent through the manifold. Shut-off valve 48 is releasably and frictionally secured through retainer ring recess 50 in the manifold in liquid-tight fashion. The shut-off valve operatively controls the flow of solvent by turning the valve handle 52 to the open or closed position. The flow of solvent from solvent tank up through drop tube 22, receiving cavity 44 and downstream solvent passage 46 is interrupted and stopped when shut-off valve handle 52 is turned to the shut-off position.

The outlet end of downstream solvent passage 46 is integrally and openly connected with downstream solvent interior tube 54 having the same inside diameter as solvent passage 46. Interior tube 54 extends longitudinally through interior opening 37 of downstream air passage 36, through rear air channel 56 and terminates at its tip end 55 partway within the restricted diameter forward air and solvent channel 60 of hose barb 58. The outside diameter of interior tube 54 is substantially smaller than the opening 37 of downstream air passage 36 and the inside diameter of rear air channel 56 but is only slightly smaller than the inside diameter of front air and solvent channel 60 of hose barb 58 because of the restricted diameter of the air and solvent channel 60. Thus, a relatively large volume annular air flows in the interior opening 37 of air passage 36 and air channel 56 around the exterior surface of interior tube 54 which passes through the interior opening 37 of air passage 36 and air channel 56. However, only a relatively small volume annular air having an increased velocity flows in restricted front channel 60 around the exterior surface to tip end 55 of interior tube 54.

Figure 2:
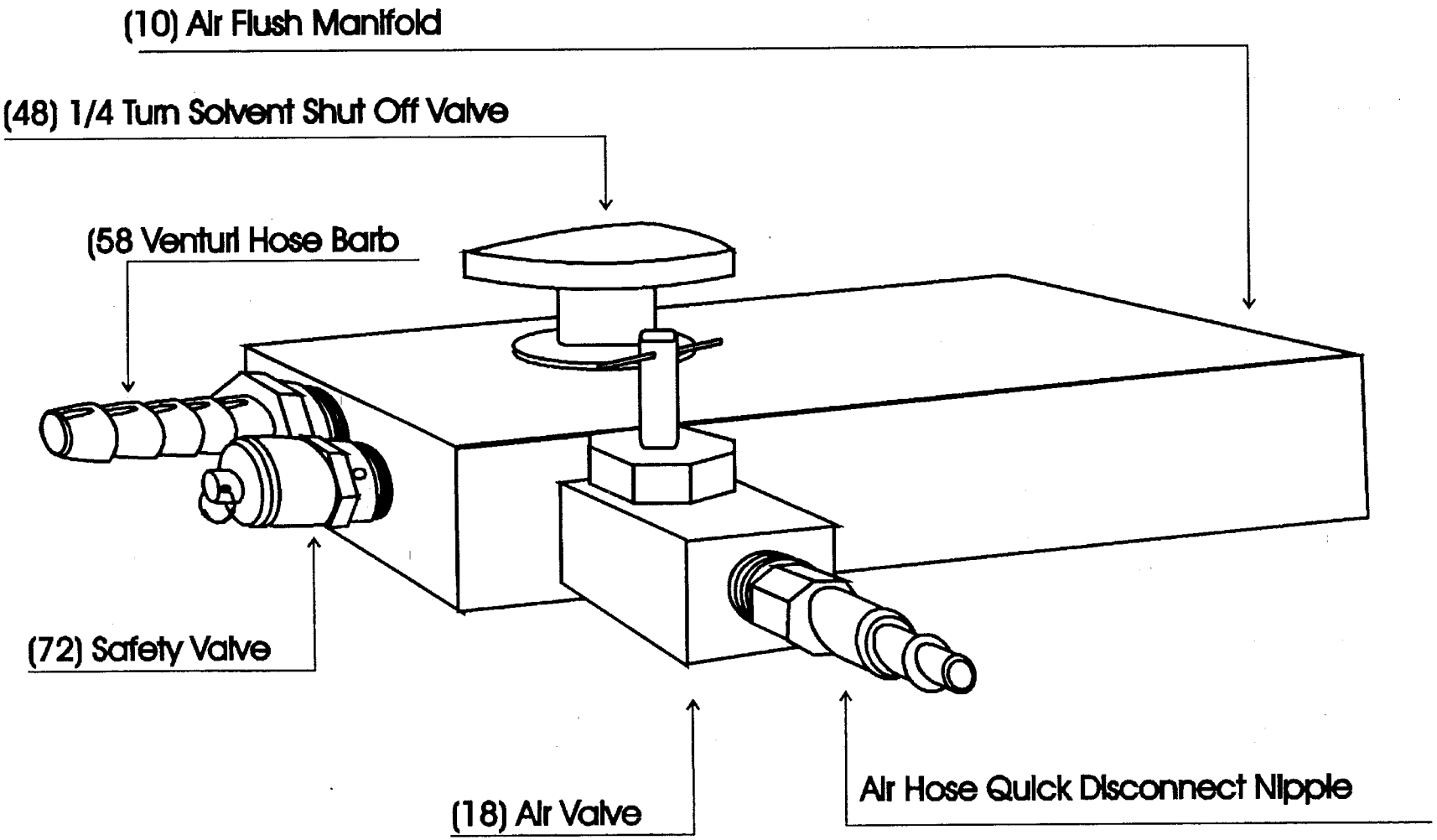
FIG. 2 is a perspective view of a preferred embodiment of the invention showing the novel air and liquid manifold.
Figure 3:
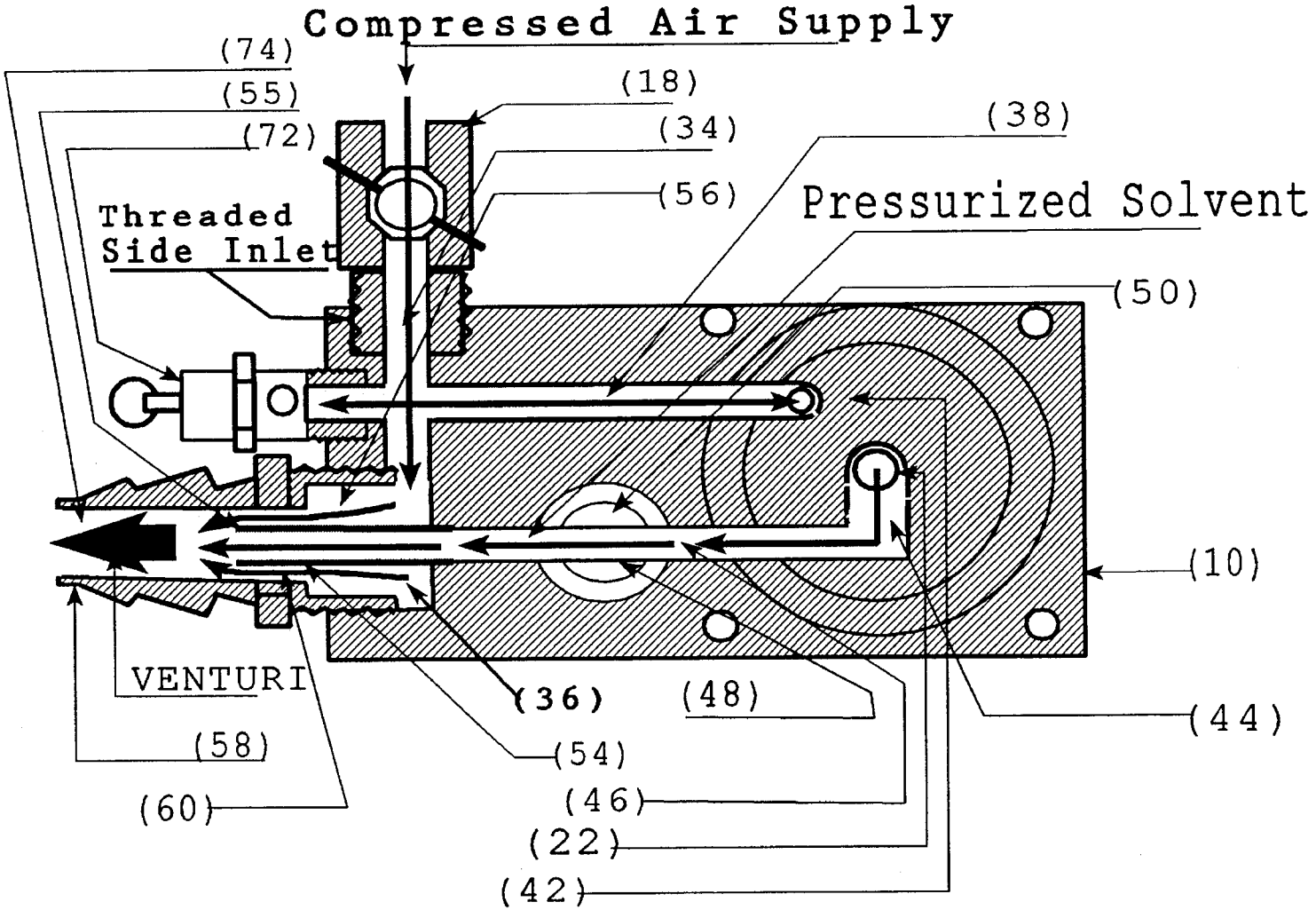
FIG. 3 is a sectional bottom view showing the novel air and liquid manifold.
Figure 4:
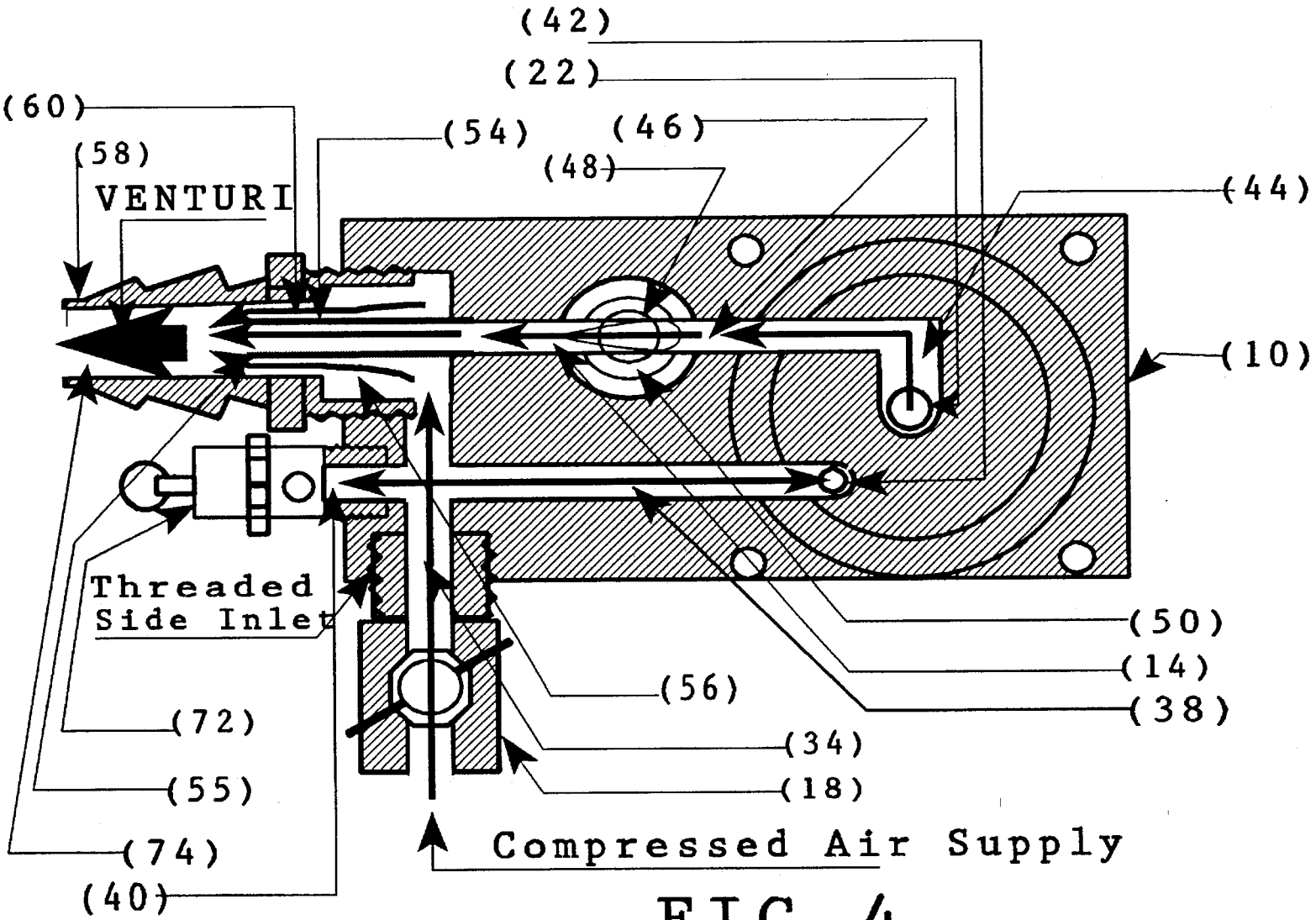
FIG. 4 is a sectional top view showing the novel air and liquid manifold.

The hose barb 58 as seen in FIGS. 2, 3 and 4 is threadedly secured to the female threaded outlet end of downstream air passage 36 creating interior opening 37 and causing the front part of rear air channel 56 and all of forward restricted channel 60 of the hose barb and the front section of interior tube 54 to project beyond the outlet end side of the manifold. Venturi flush hose 20 attaches to the ridged exterior surface of hose barb 58 encompassing flush nozzle 74 of restricted channel 60 to carry atomized mixture of solvent and air from the manifold to the fluid lines to be cleaned. Venturi flush hose 20 nay be attached by the hose barb by push lock means or other attachment.

In the operation of the apparatus, compressed air flows from air hose 16 to be regulated by air valve 18 into main air chamber 34. The compressed air passing through air chamber 34 simultaneously flows through the branch upstream air passage 38, branch safety relief air passage 40 and into downstream air passage 36. Compressed air flowing from branch air passage 38 passes through calibrated bleed orifice 42 which limits the flow of air into the air space above solvent 14 in solvent tank 12. The restricted air flow passing through calibrated air bleed orifice 42 causes only a gradual small increase in the air pressure in solvent tank 12 which increases sufficiently to force the solvent up vertical drop tube 22. The solvent flowing upward in drop tube 22 flows into solvent receiving cavity 44 and into downstream solvent passage 46. Shut-off valve 48 such as a one quarter turn shut off valve or similar device is operatively positioned close to the outlet end of downstream solvent passage 46 and controls the flow of solvent through the manifold by turning the valve handle 52 to the open or closed position. When shut-off valve 48 is in the open position, the solvent flows from downstream solvent passage 46 into solvent interior tube 54 to the terminal end tip 55 of the interior tube terminating partway within restricted forward channel 60 of venturi hose barb 58.

Concurrently with the above operation, compressed air is flowing through the large diameters of downstream interior opening 37 of air passage 36 and forward air channel 56 wherein the air flows around the exterior surface of solvent interior tube 54 therein. When this flow of air encounters the restricted diameter of rear channel 60 in the venturi hose barb 58, the flow of air is compacted. Then, as the air flows through restricted rear channel 60 around interior tube 54 it has increased velocity which appears to reduce the pressure at the tip end 55 of interior tube 54 and venturi action occurs at the terminal tip end of interior tube 54. This increases the solvent flow from interior tube 54 and back through the entire solvent flow system to the solvent entering drop tube 22 in solvent tank 12. As the solvent exits from tip end 55 of interior tube 54, it becomes an atomized mixture with the compressed air within the forward channel 60 passing through flush nozzle 74. While this increased flow of solvent is occurring, the compressed air flowing through air bleed orifice 42 is maintaining only a gradual small increase in the air pressure in the tank. As the solvent is being forced up the drop tube in the tank with the increased velocity, a small reduction in air pressure occurs in the tank which hesitantly slows the flow of solvent up drop tube 22 until the air pressure in the tank immediately builds up again. This creates a continuous rise and fall of air pressure in the tank which in turn causes an intermittent flow of solvent leaving the tank. The continuous rise and fall of the air pressure causes a rapid pulsing action of the solvent as it exits interior tube 54 in restricted forward channel 60 in the hose barb 58. The atomized mixture of solvent and air passes through flush hose 20 attached by a quick disconnect coupler or similar means to fluid lines 62 in heat exchanger 24 from which it passes through and flushes out the fluid lines. It is this pulsing action of the atomized mixture of cleaning solvent and air through the fluid lines which dislodges and removes particles and debris from the fluid lines which contamination cannot be removed by just a constant flow of cleaning liquid through the fluid lines.

After passing through and flushing out fluid lines 62 of the heat exchanger, the solvent and air mixture enters return hose 26 attached to the outlet end of the heat exchanger.

With respect to the operation of the solvent recovery system of the invention, FIG. 1 shows drain hose 26 connected to the outlet end of the fluid lines of the heat exchanger. The drain hose is coupled through drain hose barb 64 to elbow 66 to atomized solvent defuser 30 mounted through cover 70 and into enclosed drain container 28. Activated charcoal filter 32 is also mounted through cover 70 into the drain container. The combination of the position of the angles of solvent defuser 30 and the slight build-up of air pressure in drain container 28 causes a swirling action in the solvent being collected in the bottom of drain container 28. The air flowing out of the drain container 28 passes through outlet elbow 76 and is filtered through activated charcoal filter 32 to eliminate odors and emissions of solvent vapors to the atmosphere.

A further embodiment of the invention is safety valve 72 shown in FIGS. 3 and 4. The safety valve threadedly engages the female threaded outlet of safety relief branch air passage 40 which intersects with main air chamber 34. The safety valve is structured to control the air pressure build-up in the manifold to be less than about 70 p.s.i. or as required for safe operation. The safety valve operates to relieve air from the main air chamber and also serves as a warning if the system becomes blocked or restricted.

The dimensions and size of manifold 10 and solvent tank 12 depend upon the size of the fluid lines to be cleaned. It is important that the size of bleed orifice 42 restricting the flow of compressed air into the solvent tank must function in combination with the restricted air space 61 formed between interior tube 54 and the restricted forward channel 60 to control the pulsing flow of solvent and the atomization of solvent in the air flow as discussed. The dimension and size of manifold 10 which have been found to meet the requirements of the invention are as follows. The manifold has a rectangular structure about three and three quarter inches in length, about two inches in width and about one inch in depth. Bleed orifice 42 is about three sixteenths of an inch in diameter. Drop tube 22 is about ten inches in length and an inside diameter of one quarter of an inch. Interior tube 54 is about two inches in length about one quarter of an inch of the length pressed into downstream solvent passage 46, about three quarters of an inch passes inside downstream air passage 36, and rear channel 56 and about one half of an inch passes inside forward channel 60 of the venturi hose barb, resulting in that about three quarters of an inch extends beyond the outside front edge of the manifold inside venturi hose barb 58. Venturi hose barb 58 is about one and three quarter inches in length having its forward channel 56 about one half inch in length with about one quarter inch of this threaded into the manifold and about one quarter inch extending beyond the outside front edge of the manifold, and having forward channel 60 about one and one quarter inches in length while interior hose 54 extends about one half inch into restricted diameter rear channel 60. The inside diameter of rear channel 56 is about one half of an inch, the inside diameter of restricted diameter forward channel 60 is about three eights of an inch, the outside diameter of interior tube 54 is about one quarter of an inch, and restricted air space 61 being about one eight of an inch opening. The inside diameter of main air chamber 34 is about seven sixteenths of an inch and that of downstream air chamber 36 and opening 37 is about five eights of an inch. The remaining air passages have about one quarter of an inch inside diameters.

Manifold 10 may be constructed of metal, plastic or rubber. Generally, copper tubing is preferred for drop pipe 22 and interior tube 54 although other materials are applicable. A frictionally releasable shut off valve 48 has been made of plastic which has been found to function well into an aluminium or steel manifold structure.

The manifold has been used efficiently with a solvent tank having a capacity of about six gallons which is about eleven inches in diameter and about fifteen inches in length.

The foregoing disclosure and description of the invention is illustrative and explanatory thereof, and various changes in the size, shape and materials as well as the details of the illustrated construction may be made within the scope of the appended claims without departing from the spirit of the invention.

What is claimed is:

1. An apparatus for cleaning fluid lines comprising a hose for carrying cleaning liquid and air to said fluid lines, means for supplying cleaning liquid and air to said hose for cleaning said fluid lines, comprising, a source of compressed air, an enclosed tank having a reservoir partially filled with cleaning liquid, an air and liquid manifold means operatively connected to said air source and to said tank, said manifold means comprising an air flow system and a liquid distribution system, said air flow system having an air valve interconnecting said source of compressed air with an air chamber openly communicated with an upstream air passage and with a downstream air passage for simultaneously flowing compressed air therein, said upstream air passage having a predetermined restricted sized orifice openly communicating with said tank for restricting the flow of compressed air therein to gradually increase the air pressure in said tank, said downstream air passage openly air flowingly connecting with a hose barb means having an oval rear channel section integral with a restricted diameter sized oval front channel section, said liquid distribution system having a vertical liquid supply tube descending into said liquid for passing cleaning liquid to an upwardly connected downstream liquid passage having a liquid control means disposed therein which controls the flow of liquid through an interior tube extending from said downstream liquid passage longitudinally within said downstream air passage and said rear oval channel section and within said front channel section terminating at the tip end of said interior tube partway within said front channel wherein the cleaning liquid passes from said tip end into said front channel section, the exterior surface of said interior tube exposed to an open passage of air flowing through said downstream air passage and said rear channel section and a restricted passage of air flowing to its tip partway within said front channel section, where the air flow encounters said cleaning fluid passing from said tip into said rear channel section, said front channel section of said hose barb means connected to said hose for passing a mixture of cleaning liquid and pressurized air into said hose.

2. The apparatus according to claim 1 wherein said air valve includes a manual control handle for turning the air flow on and off and hence the liquid flow in said manifold.

3. The apparatus according to claim 2 wherein said air valve is releasably threadedly mounted on said manifold.

4. The apparatus according to claim 2 wherein said liquid control means includes a shut-off valve having a manual control handle for turning the cleaning liquid flow off and on and hence the cleaning liquid flow in said manifold.

5. The apparatus according to claim 4 wherein said shut-off valve is releasably frictionally mounted on said manifold.

6. The apparatus according to claim 5 wherein said shut-off valve is made of plastic.

7. The apparatus according to claim 1 wherein a safety valve is connected to the manifold for releasing the air therefrom.

8. The apparatus according to claim 7 wherein said safety air valve is connected to branch passage from said main air chamber.

9. The apparatus according to claim 1 wherein a solvent and air recovery system is connected to said fluid lines.

10. The apparatus according to claim 9 wherein said solvent and air recovery system comprises a drain hose for carrying used cleaning liquid from the fluid lines to a drain container.

11. The apparatus according to claim 10 wherein said drain container includes an attached solvent defuser having a drain hose barb and elbow for processing the used solvent.

12. The apparatus according to claim 4 wherein said drain container includes an attached air filter for filtering air to the atmosphere.

13. The apparatus according to claim 1 wherein said cleaning fluid comprises a solvent.

14. The apparatus according to claim 13 wherein said solvent comprises mineral spirits.

15. The apparatus according to claim 13 wherein said cleaning fluid comprises a compounded solvent.

16. The apparatus according to claim 1 wherein said manifold has a rectangular shape.

17. The apparatus according to claim 16 wherein said manifold comprises metal parts.

18. The apparatus according to claim 1 wherein said hose barb means is threadedly connected partway within said downstream air passage and extends beyond the exterior of said manifold.

19. The apparatus according to claim 18 wherein said interior tube extends about one half an inch into said front channel section.

20. The apparatus according to claim 19 wherein said restricted air passage between the interior tube outside surface and the front channel section inside surface is about one quarter of an inch.

21. The apparatus according to claim 20 wherein said predetermined sized orifice is about one eight of an inch in diameter.

22. An apparatus according to claim 1 wherein the restricted diameter of said oval front channel section is substantially smaller than the diameter of said oval rear channel section.

* * * * *